US010372087B2

(12) United States Patent
Sekitsuka et al.

(10) Patent No.: US 10,372,087 B2
(45) Date of Patent: Aug. 6, 2019

(54) SATELLITE RADIO WAVE RECEIVING DEVICE, RADIO CONTROLLED TIMEPIECE, METHOD OF OUTPUTTING DATE AND TIME INFORMATION, AND RECORDING MEDIUM

(71) Applicant: CASIO COMPUTER CO., LTD., Tokyo (JP)

(72) Inventors: Tatsuya Sekitsuka, Kunitachi (JP); Takeshi Matsue, Kokubunji (JP); Yuki Oshita, Tokyo (JP)

(73) Assignee: CASIO COMPUTER CO., LTD., Tokyo (JP)

( * ) Notice: Subject to any disclaimer, the term of this patent is extended or adjusted under 35 U.S.C. 154(b) by 80 days.

(21) Appl. No.: 15/388,693

(22) Filed: Dec. 22, 2016

(65) Prior Publication Data

US 2017/0269558 A1 Sep. 21, 2017

(30) Foreign Application Priority Data

Mar. 16, 2016 (JP) ..... 2016-051933

(51) Int. Cl.

| | |
|---|---|
| ***G04C 11/00*** | (2006.01) |
| ***G04R 20/06*** | (2013.01) |
| *G04G 3/00* | (2006.01) |

(52) U.S. Cl.

CPC ..... *G04R 20/06* (2013.01); *G04C 11/02* (2013.01); *G04C 11/026* (2013.01); *G04G 3/00* (2013.01)

(58) Field of Classification Search

CPC ..... G04C 11/02; G04C 11/026; G04C 11/06; G04R 20/06

See application file for complete search history.

(56) References Cited

U.S. PATENT DOCUMENTS

| | | | | |
|---|---|---|---|---|
| 6,850,573 | B1 * | 2/2005 | Noda | G11B 20/10009 375/262 |
| 8,300,687 | B1 * | 10/2012 | Eliezer | G04G 7/02 375/238 |
| 2002/0107031 | A1 * | 8/2002 | Syrjarinne | G01S 19/03 455/456.1 |
| 2004/0190378 | A1 * | 9/2004 | Farmer | H04W 56/0015 368/47 |

(Continued)

FOREIGN PATENT DOCUMENTS

JP H10-10251 A 1/1998

*Primary Examiner* — Daniel P Wicklund

(74) *Attorney, Agent, or Firm* — Scully Scott Murphy & Presser

(57) ABSTRACT

A satellite radio wave receiving device includes: a receiver that receives a satellite radio wave to identify a reception signal; and a processor that acquires primary date and time information from the identified reception signal and outputs a date and time notifying signal indicating date and time based on the primary date and time information to an outside of the satellite radio wave receiving device. The date and time notifying signal includes at least a timing notifying signal indicating a predetermined timing. The processor determines the predetermined timing without consideration of a timing of a second synchronization point which is a leading edge of every second in the date and time based on the primary date and time information, and outputs the timing notifying signal at the predetermined timing.

16 Claims, 9 Drawing Sheets

(56) References Cited

U.S. PATENT DOCUMENTS

| | | | | |
|---|---|---|---|---|
| 2004/0225439 | A1* | 11/2004 | Gronemeyer | G01R 19/16542 701/469 |
| 2008/0068236 | A1* | 3/2008 | Sheba | G04F 10/005 341/118 |
| 2008/0074950 | A1* | 3/2008 | Rostrom | G01S 19/24 368/10 |
| 2008/0212412 | A1* | 9/2008 | Pikula | G04G 15/006 368/47 |
| 2012/0063447 | A1* | 3/2012 | Tyrrell | H04W 56/00 370/350 |

* cited by examiner

SATELLITE RADIO WAVE RECEIVING DEVICE, RADIO CONTROLLED TIMEPIECE, METHOD OF OUTPUTTING DATE AND TIME INFORMATION, AND RECORDING MEDIUM

CROSS-REFERENCE TO RELATED APPLICATIONS

This application is based upon and claims the benefit of priority from the prior Japanese Patent Application No. 2016-051933 filed on Mar. 16, 2016, the entire contents of which are incorporated herein by reference.

BACKGROUND OF THE INVENTION

Field of the Invention

The present invention relates to a satellite radio wave receiving device, a radio controlled timepiece, a method of outputting date and time information, and a recording medium.

Description of the Related Art

Heretofore, there are known electronic timepieces (radio controlled timepieces) which involve technique that receives radio waves carrying date and time information to acquire the date and time information for maintaining correct count of date and time. Such radio controlled timepieces that can acquire correct date and time eliminate the need for manual correction by users and facilitate accurate correction of the date and time during continuous time counting and display.

One example of sources of the radio waves carrying the date and time information is positioning satellites in the Global Positioning System (GPS), which is one of the Global Navigation Satellite Systems (GNSS). Radio waves in a global common format can be received from the positioning satellites in the same positioning system in any field open to the sky, and are preferably used in portable timepieces, such as watches, carried by users in motion.

Japanese Patent Application Laid-Open Publication No. Hei 10-10251, for example, discloses a radio controlled timepiece which conducts operations, such as reception of satellite radio waves and decoding of date and time information, with a dedicated module (satellite radio wave receiving device). The date and time information received by the module is output to a main processor of the radio controlled timepiece to correct the date and time. The main processor of the radio controlled timepiece thus needs to acquire the date and time information from the module at a proper timing. Upon identification of the date and time from the satellite radio waves, the typical satellite radio wave receiving device outputs the date and time information in the date-hour-minute-second format in synchronization with the timing exactly on the second including no fraction. This facilitates the timing synchronization with the radio controlled timepiece to acquire the correct date and time with the main processor of the radio controlled timepiece.

Unfortunately, the outputs of the date and time information from the satellite radio wave receiving device in uniform synchronization with the timings exactly on the seconds generate unwanted waiting times before the outputs depending on the timings of the identification of the date and time information. Such generation of the waiting times directly leads to a variation in waiting time of a user, an increase in unwanted waiting time, and an increase in operation time required for the correction of the date and time, i.e., an increase in excess power consumption. Such problems lead to low convenience and low flexibility in the date and time adjustment.

SUMMARY OF THE INVENTION

An object of the present invention is to provide a satellite radio wave receiving device, a radio controlled timepiece, a method of outputting date and time information, and a recording medium, for more flexible output of the date and time information.

To solve the above problems, there is provided a satellite radio wave receiving device including: a receiver that receives a satellite radio wave to identify a reception signal; and a processor that acquires primary date and time information from the identified reception signal and outputs a date and time notifying signal indicating date and time based on the primary date and time information to an outside of the satellite radio wave receiving device, wherein the date and time notifying signal includes at least a timing notifying signal indicating a predetermined timing, and the processor determines the predetermined timing without consideration of a timing of a second synchronization point which is a leading edge of every second in the date and time based on the primary date and time information, and outputs the timing notifying signal at the predetermined timing.

BRIEF DESCRIPTION OF THE SEVERAL VIEWS OF THE DRAWINGS

The above and further objects, features and advantages of the present invention will be made clearer by the following detailed description and the attached drawings, in which.

DETAILED DESCRIPTION OF THE PREFERRED EMBODIMENTS

Embodiments of the present invention will now be described with reference to the accompanying drawings.

First Embodiment

Figure 1:
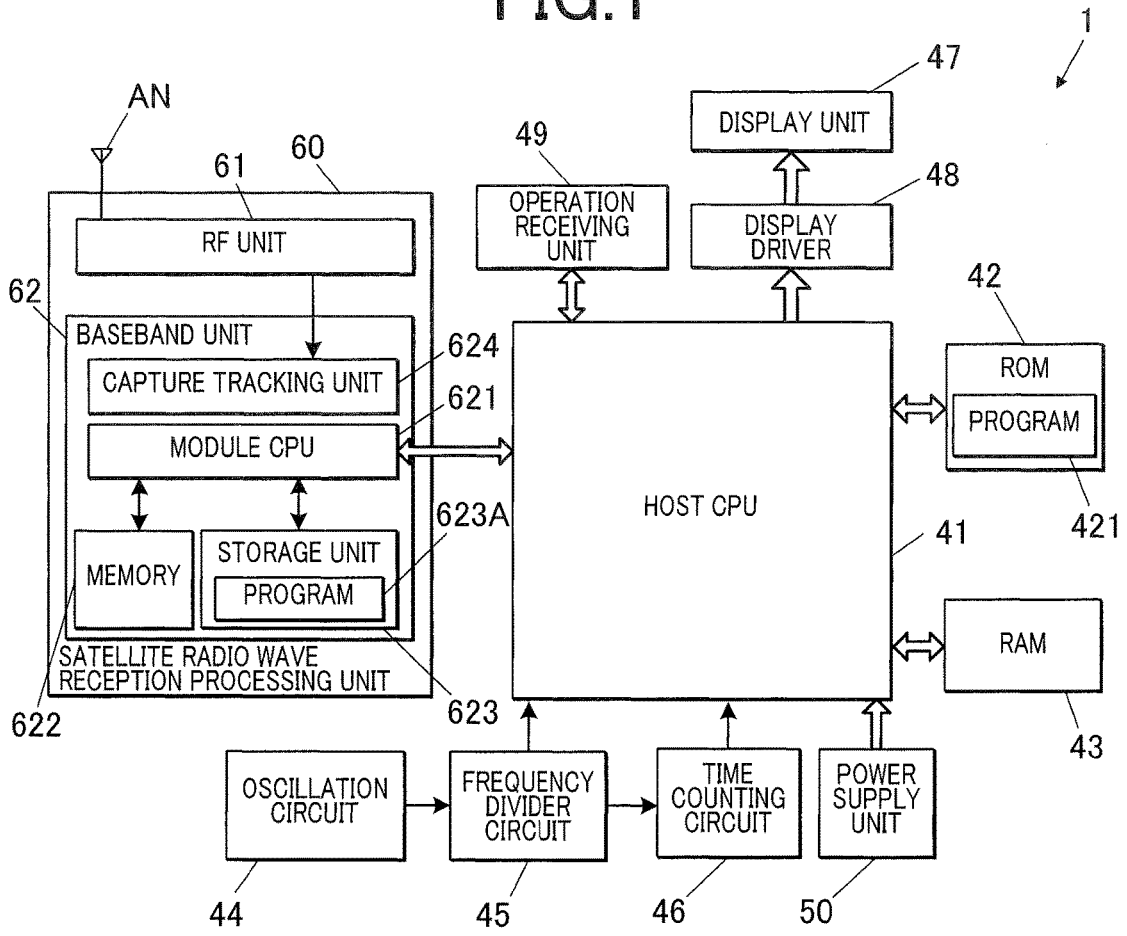
FIG. 1 is a block diagram of a functional configuration of an electronic timepiece according to a first embodiment.

FIG. 1 is a block diagram of a functional configuration of an electronic timepiece 1 according to a first embodiment of the present invention.

The electronic timepiece 1 is a radio controlled timepiece capable of receiving satellite radio waves at least from positioning satellites in the U.S. Global Positioning System (hereinafter referred to as GPS satellites), and demodulating signals to acquire the data and time information and perform positioning.

The electronic timepiece 1 includes a host Central Processing Unit (CPU) 41 as a timepiece operation control unit, a Read Only Memory (ROM) 42, a Random Access Memory (RAM) 43 as a storage unit, an oscillation circuit 44, a frequency divider circuit 45, a time counting circuit 46, a display unit 47, a display driver 48, an operation receiving unit 49, a power supply unit 50, a satellite radio wave reception processing unit 60 as a satellite radio wave receiving device, and an antenna AN, for example.

The host CPU 41 is a processor that executes various types of arithmetic processing and comprehensively controls the overall operation of the electronic timepiece 1. The host CPU 41 reads a control program from the ROM 42 and loads the program into the RAM 43 to execute various operation processes such as displaying date and time and performing computing control and/or display of various functions. In addition, the host CPU 41 causes the satellite radio wave reception processing unit 60 to receive radio waves from the positioning satellites, acquires the information on date, time, and position obtained based on the received contents, and corrects the date and time counted by the time counting circuit 46 based on the acquired date and time information.

The ROM 42 is a mask ROM or a rewritable non-volatile memory, for example, and stores control programs and default setting data. The control programs include a program 421 for controlling various processes of acquiring various pieces of information from the positioning satellites.

The RAM 43 is a volatile memory, such as a SRAM and DRAM, that provides a working memory area for the host CPU 41, and stores temporal data and various types of setting data. The setting data includes parameters for count of date and time, determination of a home area in association with a selected time zone to be displayed, and application of the daylight-saving time. Part or the entire of the setting data stored in the RAM 43 may be stored in a non-volatile memory. The RAM 43 also stores information on the timing of the latest correction of the date and time counted by the time counting circuit 46, and the information is updated after every correction.

The oscillation circuit 44 generates and outputs predetermined frequency signals (clock signals). The oscillation circuit 44 is a quartz oscillator, for example.

The frequency divider circuit 45 divides the frequency signals received from the oscillation circuit 44 into signals having frequencies to be processed at the time counting circuit 46 and/or the host CPU 41, and outputs the divided signals. The frequencies of the signals to be output may be varied based on the setting by the host CPU 41.

The time counting circuit 46 counts the number of inputs of predetermined time counting signals received from the frequency divider circuit 45 and adds the counted number to an initial value to count the current date and time. The time counting circuit 46 may be incorporated in software for changing values to be stored in the RAM, or may be provided with a dedicated counter circuit. The date and time counted by the time counting circuit 46 may be any of accumulated time from a predetermined start time, the UTC date/time (coordinated universal time), and the date and time of a predetermined home area (local time). The date and time counted by the time counting circuit 46 is not necessarily be retained in the year-month-day or hour-minute-second format.

The oscillation circuit 44, the frequency divider circuit 45, and the time counting circuit 46 constitute a time counting unit.

The degree of deviation (rate) per day between the date and time counted by the time counting circuit 46, which is obtained through the counting operation of the time counting signals generated from the clock signals output from the oscillation circuit 44, and the correct date and time varies depending on various parameters of the operational environment, in particular, temperature. In a possible environment under conditions of general use of the electronic timepiece 1, the degree of deviation is less than 0.6 seconds. A maximum amount of deviation assumed to be contained in the date and time counted by the time counting circuit 46 (assumed maximum amount of deviation: maximum error) thus can be calculated by multiplying elapsed days from the previous (latest) correction of the date and time information by 0.6 seconds. Within the conditions of use of the electronic timepiece 1, a relation between increase/decrease in temperature from the reference temperature and positive/negative of the rate is uniquely defined.

The date and time counted by the time counting circuit 46 can be corrected under an instruction from the host CPU 41.

The display unit 47 is provided with a display screen, such as a Liquid Crystal Display (LCD) or an organic Electro-Luminescent (EL) display, for example, and conducts a digital display operation of the date and time and various functions based on any one of the dot matrix system and the segment system or the combination thereof.

The display driver 48 outputs drive signals corresponding to the type of the display screen to the display unit 47, in response to control signals from the host CPU 41, and causes the display unit 47 to perform display on the display screen.

Alternatively, the display unit 47 may perform display based on the analog system turning plural points by a stepping motor via a gear train mechanism.

The operation receiving unit 49 receives input operations from a user, and outputs electric input signals corresponding to the input operations to the host CPU 41. The operation receiving unit 49 includes a push-button switch and a winding crown, for example.

Alternatively, the operation receiving unit 49 may be a touch sensor disposed on the display screen of the display unit 47, and the display screen thereby functions as a touch panel that outputs operational signals in response to detection of positions/manners of the touching movements of the user by the touch sensor.

The power supply unit 50 includes a battery, and provides each unit of the electronic timepiece 1 with power required for the operation of the electronic timepiece 1 by an operating voltage of the battery. In this embodiment, the battery of the power supply unit 50 is a primary battery, such as a button-type dry battery. Alternatively, a solar panel and a secondary battery may be used as the battery, the secondary battery being charged or discharged depending on a magnitude of electromotive force generated by incident light on the solar panel.

The satellite radio wave reception processing unit 60 is synchronized with radio waves from the positioning satellites (satellite radio waves) via the antenna AN to identify and capture specific C/A codes (pseudo random noises) of the positioning satellites and thereby receives the radio waves. The satellite radio wave reception processing unit 60 then demodulates/decodes the navigation messages transmitted from the positioning satellites to acquire necessary information. The satellite radio wave reception processing unit 60 includes an RF unit 61 and a baseband unit 62, for example.

The RF unit 61 receives the satellite radio waves of L1 band (1.57542 GHz in the GPS satellites), selectively allows the signals from the positioning satellites to pass the RF unit 61 to amplify the signals, and converts the signals into intermediate frequency signals. The RF unit 61 includes a Low-Noise Amplifier (LNA), a Band Pass Filter (BPF), a local oscillator, and a mixer, for example.

The baseband unit 62 applies the C/A codes of the positioning satellites to the intermediate frequency signals acquired through the conversion at the RF unit 61 to generate baseband signals or code strings of the navigation messages, and thereby acquires information on date, time, and position from the acquired code strings.

The baseband unit 62 includes a module CPU 621 as a processor, a memory 622, a storage unit 623, and an capture tracking unit 624, for example.

The capture tracking unit 624 calculates correlation values between the intermediate frequency signals generated at the RF unit 61 and the C/A codes in the phases of the positioning satellites to specify the peak correlation value. The capture tracking unit 624 thereby performs a capturing operation for identifying the types and phases of the C/A codes included in the received radio waves. Based on the identified C/A code and the identified phase of the C/A code, the capture tracking unit 624 also feedbacks the phase information for continuous acquisition of the code strings of the navigation messages transmitted from the positioning satellite corresponding to the identified C/A code to track the captured signals, and demodulates the received radio waves to identify the codes (reception signals).

The RF unit 61 and the capture tracking unit 624 constitute a receiver. The receiver may include the module CPU 621.

The module CPU 621 is a processor (computer for the satellite radio wave receiving device) that controls the operation of the satellite radio wave reception processing unit 60 in response to inputs of the control signals and setting data from the host CPU 41. The module CPU 621 reads necessary programs and setting data from the storage unit 623 to operate the RF unit 61 and the capture tracking unit 624. The module CPU 621 then tracks and demodulates the radio waves captured from the positioning satellite with the RF unit 61 and the capture tracking unit 624 to identify code strings, acquires the date and time information from the identified code strings, and outputs the acquired information to the host CPU 41 (the outside of the satellite radio wave reception processing unit 60). The module CPU 621 may decode the code strings contained in the received radio waves to acquire the date and time information, or may sequentially compare the demodulated codes with an assumed code string preliminarily generated for the comparison to detect consistency therebetween, and determine the deviation amount from the assumed date and time.

The memory 622 is a RAM providing a working memory area for the module CPU 621 in the satellite radio wave reception processing unit 60. The memory 622 stores temporal data used for identification and decoding of the codes.

The storage unit 623 stores various types of setting data for GPS positioning, and histories of positioning and acquisition of the date and time information. The storage unit 623 may be any non-volatile memory, such as flash memory or an Electrically Erasable and Programmable Read Only Memory (EEPROM). Examples of the data stored in the storage unit 623 include precise orbital information of positioning satellites (ephemeris), assumed orbital information (almanac), and the date, time, and position of the last positioning. The storage unit 623 further stores data of worldwide time zones and application of the daylight-saving time in the form of a time difference table. After the positioning, the local time information, such as a time difference of the standard time at the measured current position from the coordinated universal time (UTC) and information on application of the daylight-saving time, is specified with reference to the time difference table.

The storage unit 623 stores a program for executing positioning to specify the local time information and a program 623A for receiving and acquiring the date and time information that are read and executed by the module CPU 621.

The satellite radio wave reception processing unit 60 receives electric power directly from the power supply unit 50, and is turned on/off in response to control signals from the host CPU 41. In detail, power supply to the satellite radio wave reception processing unit 60 is turned off independently from the host CPU 41, which is always turned on, during the idling period that does not involve calculating operations for receiving radio waves from the positioning satellite, acquiring the date and time, and measuring the position.

The format of the navigation message transmitted from the GPS satellite will now be described.

In the GNSS, radio waves transmitted from different positioning satellites distributed along the orbit moving around the earth can be simultaneously received at an observation point. Information on the current positions of the available positioning satellites and information on the date and time are received from four or more positioning satellites (three positioning satellites if the observation point is on the ground). The three-dimensional position coordinate, date, and time of the observation point can be determined based on the received data and the deviation among the reception timings, i.e., the difference in the propagation times (distances) from the positioning satellite. In addition, the current date and time can be determined from the date and time information from one positioning satellite within an error range of about 65 msec to about 90 msec of the propagation time from the positioning satellite.

The code strings (navigation messages) indicating the information on date and time (primary date and time information), the information on the satellite position (orbit), and the status information of the satellite, such as a physical condition of the satellite, are phase-modulated with the C/A code (pseudo random noise) and transmitted from the positioning satellite by a spread spectrum system. The positioning system has its own format for the signal transmission (format for the navigation message).

Figure 2:
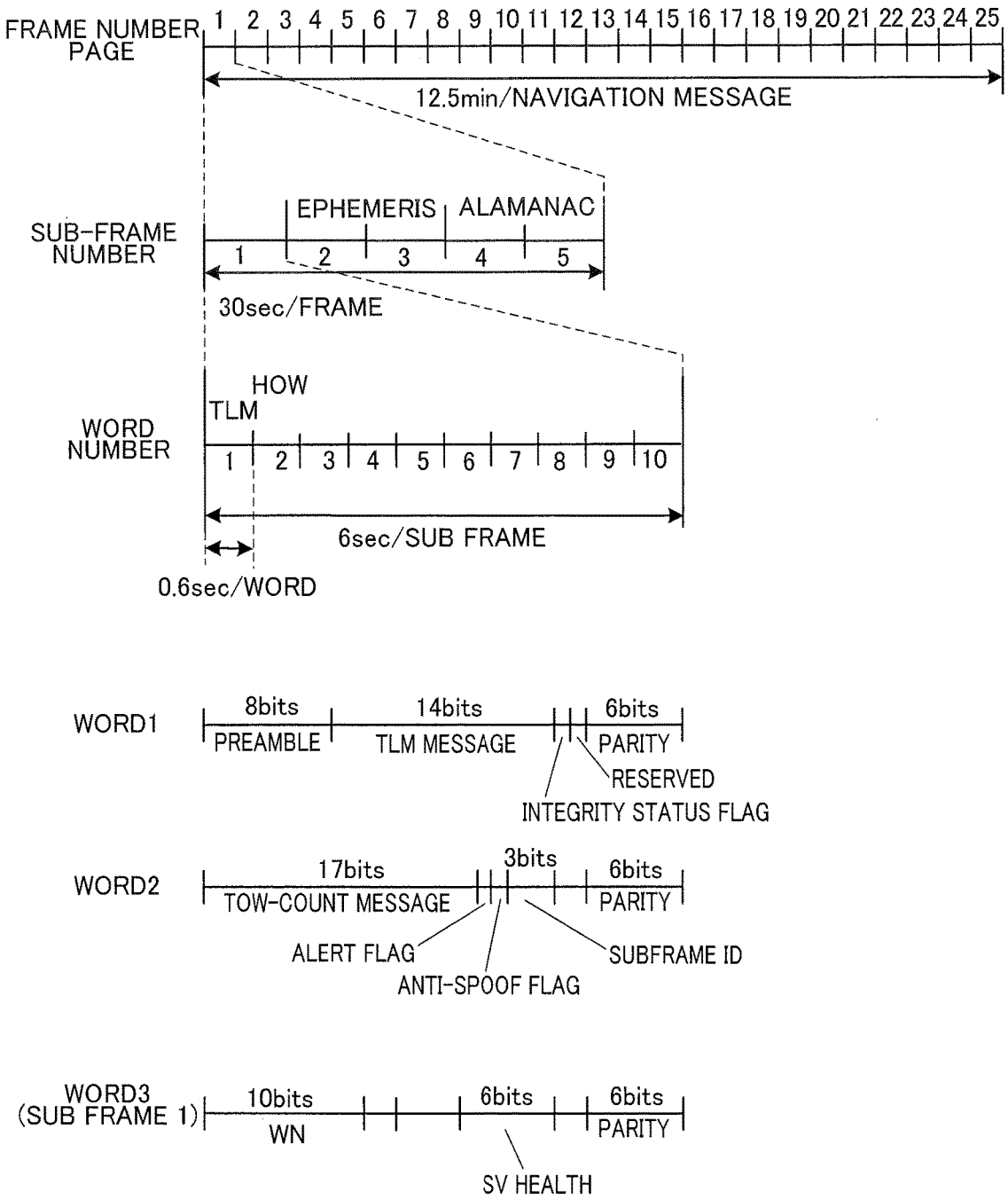
FIG. 2 is an illustrative diagram of a format of a navigation message transmitted from a GPS satellite.

FIG. 2 is an illustrative diagram of the format of the navigation message transmitted from the GPS satellite.

In the GPS, each GPS satellite transmits 25 pages of frame data each for 30 seconds, and thus outputs the entire data in a 12.5-minute cycle. In the GPS, each positioning satellite has a specific C/A code, and each C/A code consists of repeated arrangements of 1023 chips at 1.023 MHz in a 1-msec cycle. The leading chips are in synchronization with an internal timepiece in the GPS satellite; therefore, detection of the phase shift of the leading chip for each GPS satellite determines the phase shift (pseudo distance)

depending on the propagation time, i.e., the distance from the GPS satellite to the current position.

Each frame consists of five sub-frames (6 seconds for each sub-frame). Each sub-frame consists of ten words (code blocks, 0.6 seconds for each, referred to as WORD 1 to WORD 10, in order). Each word has a 30-bit length (i.e., the number of codes is 30). The GPS satellite thus transmits 50-bit codes per second.

The data formats of WORD 1 are identical to those of WORD 2 in all sub-frames. WORD 1 includes, in sequence, a preamble, which is an 8-bit fixed code string, a 14-bit telemetry message (TLM message), a 1-bit integrity status flag, a 1-bit reserved bit, and a 6-bit parity code string (parity-check codes). WORD 2 includes an arrangement of, in sequence, a 17-bit time of week (TOW-) count (also referred to as Z count) indicating an elapsed time within a week, a 1-bit alert flag, a 1 bit anti-spoof flag, a 3-bit sub-frame ID indicating the number of the sub-frame (period number), a 2-bit parity-string matching code, and a 6-bit parity code string.

The data contained in WORD 3 to WORD 10 is different for every sub-frame. WORD 3 in Sub-frame 1 includes a 10-bit week number (WN) at its leading edge. Sub-frames 2 and 3 mainly include an ephemeris (precise orbital information), and apart of Sub-frame 4 and Sub-frame 5 include an almanac (assumed orbital information).

It should be noted that the date and time counted by the GPS satellite (GPS date and time) do not include a deviation caused by a leap second. The GPS date and time thus has a deviation from the UTC date and time. Accordingly, the date and time acquired through the reception of radio waves from the GPS satellite should be converted into the UTC date and time before being output. In the case where the reception timings of radio waves from the GPS satellite is controlled or the date and time to be received from the GPS satellite are assumed based on the date and time counted by the time counting circuit 46, the date and time counted by the time counting circuit 46 should be converted into the GPS date and time. It should be also noted that the date and time transmitted in each sub-frame correspond to the date and time at the leading edge of the next sub-frame.

The acquiring operation of the date and time information executed in the electronic timepiece 1 according to the embodiment will now be described.

To decode the navigation message to acquire the date and time, the WNs and TOW-counts need to be identified. To specify the code portion thereof, the preambles are generally identified first. If the date and time counted by the time counting circuit 46 is not largely different from the correct date and time, the information corresponding to the WNs can be preliminarily specified based on the date and time counted by the time counting circuit 46, without the reception and identification of the WNs. In detail, the electronic timepiece 1 is generally required to receive at least two or three words (1.2 to 1.8 seconds) from the leading edge of each preamble (i.e., the leading edge of each sub-frame). In this case, part of two adjacent sub-frames may be received and identified depending on a start timing of the reception.

In general, this process involves not only demodulation, identification and decode of the TOW-counts but also identification of all codes (including the preambles and the TOW-counts) in WORDs 1 and 2 to obtain parity values (parity data) corresponding to the 6-bit parity code strings of WORD 1 and WORD 2 from these codes. The parity values are compared with the parity code strings to confirm if the preambles and TOW-counts are correctly identified.

Instead of decoding the navigation message described above, a code string (assumed code string) assumed to be received may be preliminarily generated based on the date and time counted by the time counting circuit 46, and the assumed code string may be compared with the demodulated and identified code string that have been received to identify the matched timing. Correct date and time can be acquired based on the identified timing and the date and time corresponding to the assumed code string. In this case, the assumed code string includes only codes predictable from the date and time information, etc. The assumed code string, thus, generally includes the preamble and TOW-count. In view of prevention of incidental matching between the assumed code string and the received code string, the assumed code string should coincide with the received code string in about two to ten words (1.2 to 6 seconds).

As described above, the acquisition of the correct date and time using radio waves from the GPS satellite involves different identification timings of the date and time information, depending on the start timings of the reception and time required for the reception. In the electronic timepiece 1 according to the embodiment, the satellite radio wave reception processing unit 60 (module CPU 621) outputs a pulse signal to the host CPU 41 upon the acquisition of the date and time information, and then transmits the date and time of the output of the pulse signal on the order of milliseconds (the order of less than one second).

Figure 3:
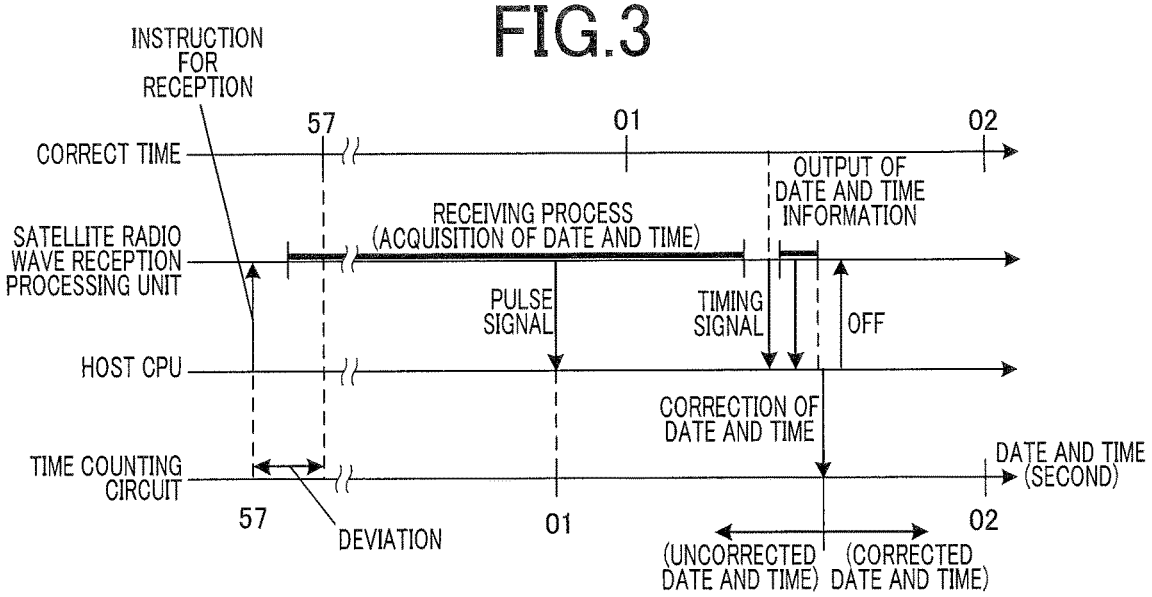
FIG. 3 is a timing chart of an operation for acquiring date and time information by the electronic timepiece according to the first embodiment.

FIG. 3 is a timing chart of the operation for acquiring the date and time information.

In the electronic timepiece 1, the time and date counted by the time counting circuit 46 generally has a minor deviation from the correct date and time. In this embodiment, the date and time counted by the time counting circuit 46 include an advance of about 0.2 seconds from the correct date and time.

At a predetermined timing in the date and time counted by the time counting circuit 46 or at the reception of an instruction to acquire the date and time information through a user operation, the host CPU 41 starts up the satellite radio wave reception processing unit 60 and transmits an instruction to receive and acquire the date and time information thereto. The satellite radio wave reception processing unit 60 starts a reception process to capture and track the satellite radio waves and conduct the operation for acquiring the date and time information.

During the reception process, the satellite radio wave reception processing unit 60 may output pulse signals indicating that the date and time information has not been received every time the timings exactly on the second come, the second being counted by the time counting circuit 46 and including no fraction. After the reception process is completed, the satellite radio wave reception processing unit 60 outputs a timing signal (timing notifying signal) to the host CPU 41 immediately (in other words, without waiting for (without consideration of) a second synchronization point), and then outputs the date and time information (set date and time signal) indicating the date and time of output of the timing signal to the host CPU 41. The date and time information to be transmitted at this stage is date and time data having millisecond-order accuracy, or date and time data having second-order accuracy and a millisecond-order time difference to the next timing exactly on the second to be separately transmitted from the millisecond-order data, for example. Alternatively, in the case where the timing signal is transmitted in synchronization with a signal having a predetermined frequency (of higher than 1 Hz), the period number of the frequency signal may be transmission information. The timing signal and the date and time information constitute a date and time notifying signal.

The host CPU 41 determines the correct date and time based on the acquired date and time information and the reception timing of the timing pulse, and corrects the date and time counted by the time counting circuit 46.

Figure 4:
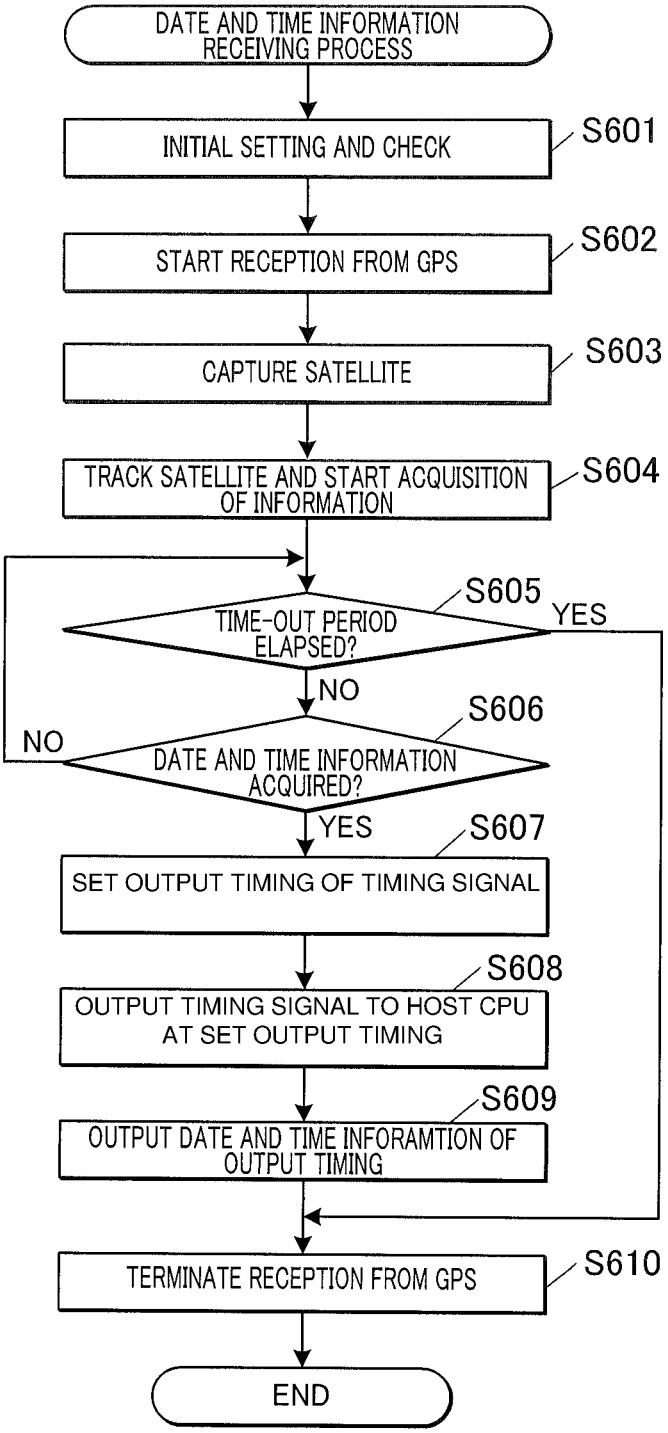
FIG. 4 is a flow chart illustrating a control procedure for date and time information receiving process executed in the electronic timepiece according to the first embodiment.

FIG. 4 is a flow chart illustrating a control procedure of the module CPU 621 for date and time information receiving process executed in the satellite radio wave reception processing unit 60.

The date and time information receiving process, which is one embodiment of a method of outputting date and time information according to the present invention, starts after the start-up of the satellite radio wave reception processing unit 60 by the host CPU 41 and the reception of the instruction to acquire the date and time information.

Upon the start of the date and time information receiving process, the module CPU 621 conducts an operation for initial setting and check for start-up (Step S601). In the initial setting, the module CPU 621 obtains the date and time information counted by the time counting circuit 46 (secondary date and time information) and maximum error information on an assumed maximum deviation amount of the date and time counted by the time counting circuit 46 from the host CPU 41, and thereby determines whether the reception of the WN is required or not, for example. The module CPU 621 then starts receiving radio waves from the GPS satellite (Step S602). The module CPU 621 starts the operation of the RF unit 61 and the capture tracking unit 624.

The module CPU 621 causes the capture tracking unit 624 to conduct an operation for capturing radio waves from the GPS satellite (Step S603). The capturing operation generally requires several (about two to three) seconds or may require additional seconds if low-intensity or noise-containing radio waves are received. Once the radio waves from the GPS satellite are captured, the module CPU 621 starts tracking of the captured radio waves and acquisition of information (Step S604). If excess radio waves are captured from the GPS satellites, the module CPU 621 may selectively track a required number of radio waves having a higher intensity, without tracking of the remaining radio waves, for example.

The module CPU 621 checks for a lapse of a predetermined time-out period (Step S605). If the lapse of the time-out period is determined ("YES" in Step S605), the procedure of the module CPU 621 goes to Step S610.

If the lapse of the time-out period is not determined ("NO" in Step S605), the module CPU 621 determines whether the date and time information is acquired or not (Step S606). If the module CPU 621 determines that the date and time information is not acquired ("NO" in Step S606), the procedure of the module CPU 621 returns to Step S605.

If the module CPU 621 determines that the date and time information is acquired ("YES" in Step S606), the module CPU 621 sets the date and time of output timing of a timing signal to the host CPU 41 (Step S607). The module CPU 621 outputs the timing signal to the host CPU 41 at the set output timing (Step S608), and then outputs the millisecond-order date and time information on the output timing to the host CPU 41 (Step S609). The procedure of the module CPU 621 then goes to Step S610.

In Step S610, the module CPU 621 terminates the reception of radio waves from the GPS satellite (Step S 610). The module CPU 621 then terminates the date and time information receiving process.

Among these steps, Steps S604 and S606 correspond to a date and time acquiring step (date and time acquisition means), and Steps S607 to S609 correspond to an outputting step (output means).

Figure 5:
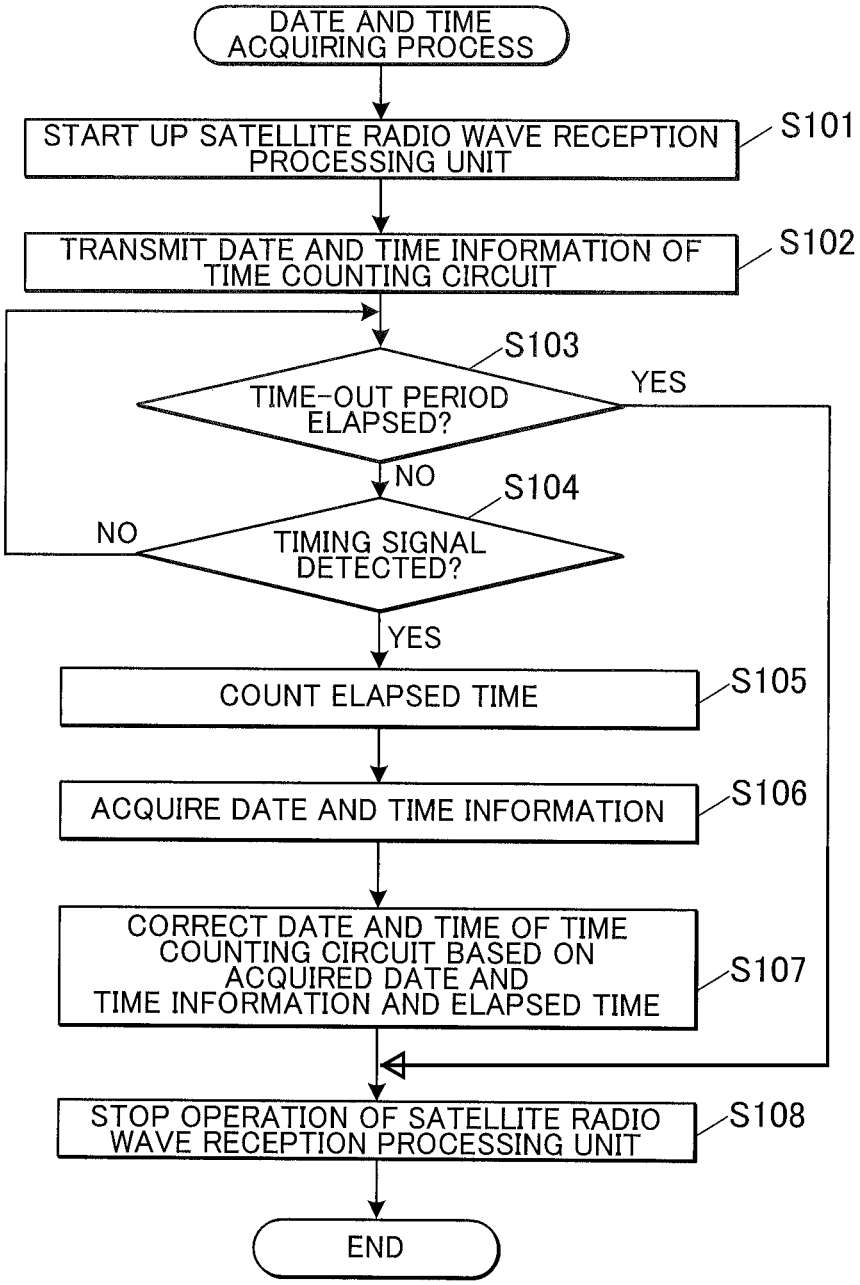
FIG. 5 is a flow chart illustrating a control procedure for date and time acquiring process executed in the electronic timepiece according to the first embodiment.

FIG. 5 is a flow chart illustrating a control procedure of the host CPU 41 for the date and time acquiring process executed in the electronic timepiece 1 according to the embodiment.

The date and time acquiring process is performed in response to detection of a predetermined input operation on the operation receiving unit 49 by a user or is performed once a day, for example, when a predetermined condition is satisfied. For example, the predetermined condition may be the first detection of light intensity larger than a predetermined reference light intensity by a light detecting sensor (not shown) in the day.

Upon the start of the date and time acquiring process, the host CPU 41 causes the power supply unit 50 to supply electric power to the satellite radio wave reception processing unit 60 to start up the satellite radio wave reception processing unit 60 (Step S101). The host CPU 41 sends the satellite radio wave reception processing unit 60 an instruction to acquire the date and time information together with the information on the current date and time counted by the time counting circuit 46 (secondary date and time information) and the maximum error information described above (Step S102). The host CPU 41 starts counting an elapsed time from the instruction to acquire the date and time information.

The host CPU 41 waits for an input of a timing signal from the satellite radio wave reception processing unit 60, and determines whether the elapsed time from the instruction to acquire the date and time information excesses a time-out period or not (Step S103). If it is determined that the elapsed time exceeds the time-out period ("YES" in Step S103), the procedure of the host CPU 41 goes to Step S108. If it is determined that the elapsed time does not exceed the time-out period ("NO" in Step S103), the host CPU 41 determines whether a timing signal from the satellite radio wave reception processing unit 60 is detected or not (Step S104). If it is determined that the timing signal is not detected ("NO" in Step S104), the procedure of the host CPU 41 goes to Step S103.

If it is determined that the timing signal is detected ("YES" in Step S104), the host CPU 41 counts an elapsed time from the detection of the timing signal (Step S105). The host CPU 41 then acquires the date and time information from the satellite radio wave reception processing unit 60 (Step S106). The host CPU 41 obtains the current date and time based on the acquired date and time information and the counted elapsed time, and corrects the date and time counted by the time counting circuit 46 based on the current date and time (Step S107). The procedure of the host CPU 41 goes to Step S108.

In Step S108, the host CPU 41 stops the operation of the satellite radio wave reception processing unit 60 and the power supply from the power supply unit 50 (Step S108) to terminate the date and time acquiring process.

As described above, the satellite radio wave reception processing unit 60 of the electronic timepiece 1 according to the first embodiment includes: the RF unit and the capture tracking unit 624 for receiving satellite radio waves and identifying reception signals; and the module CPU 621 for acquiring the date and time information from the identified reception signals to output the date and time notifying signal indicating the date and time corresponding to the acquired date and time information to the host CPU 41. The date and time notifying signal includes at least a timing signal indicating a predetermine timing. The module CPU 621 determines the predetermined timing without consideration of the second synchronization point, which is the leading edge of every second in the date and time corresponding to the date and time information, and outputs the timing signal at the predetermined timing.

This operation does not require a waiting time, before outputting the date and time information, from the acquisition of the date and time information to the next second synchronization point. The electronic timepiece 1 thus can have higher flexibility than traditional technique in the notification of the date and time to the module CPU 621 after the acquisition of the date and time information. In particular, the delay times from the acquisition of the date and time information to the outputs of the timing signals can be set to proper times, respectively, so that they become uniform. These advantages can improve convenience of users without causing an unwanted waiting time and reduce the operating power of the satellite radio wave reception processing unit 60 required in the unwanted waiting time.

Since the date and time notifying signal includes the information on the date and time of the output timing of the timing signal, namely, the millisecond-order information, any output timing other than the timing exactly on the second can be flexibly fixed. In addition, this millisecond-order date and time may have a frequency for detecting the timing signal by the host CPU 41, generally within the rage of several tens of Hertz to several hundred Hertz. The frequency requires one byte or several bytes at most, which brings little impact on an increase in data volume.

The module CPU 621 receives from the host CPU 41 the secondary date and time information counted by the time counting circuit 46 and maximum error information on a maximum error (an assumed maximum deviation amount) assumed to be contained in the date and time indicated by the secondary date and time information. The module CPU 621 acquires, as the primary date and time information, part of information capable of specifying the date and time within the range of the assumed maximum deviation amount (e.g. a range of less than 0.6 seconds at a maximum) based on the secondary date and time information, i.e. the timing of the leading edge of any word, from among the date and time information available from the satellite radio waves received by the RF unit 61 and the capture tracking unit 624. The module CPU 621 then determines the date and time to be transmitted to the host CPU 41 based on the primary and secondary date and time information.

Such preliminary reception of the date and time information and the error information thereof from the time counting circuit 46 and the host CPU 41 can eliminate the need for reception of the entire date and time information from the positioning satellites, resulting in a reduction in time required for the reception of the radio waves, a decrease in waiting time of a user, and low electric power consumption for the reception of the radio waves.

The reception signal includes a parity-check code for every word. The module CPU 621 compares the parity data determined from the codes of every word with the parity-check code contained in every word, and acquires the primary date and time information based on the results of the comparison.

Such a parity-check operation can improve the accuracy of the acquired data. A conventional technique generates unwanted deviations in the waiting times from the acquisition of the date and time information to the outputs of the timing signals, due to variation in relation of every word with the second synchronization point of the order of 1.0 second; however, the acquisition of the date and time information after the parity comparison in every word of the order of 0.6 seconds can set the waiting times to proper processing times, respectively, so that they become uniform, and output the timing signals at proper timings.

As described above, the electronic timepiece 1 according to the embodiment includes the satellite radio wave reception processing unit 60, the time counting circuit 46 counting date and time, the display unit 47 displaying the date and time based on the date and time counted by the time counting circuit 46, and the host CPU 41 receiving the date and time notifying signal from the satellite radio wave reception processing unit 60 to correct the date and time counted by the time counting circuit 46.

In the electronic timepiece 1, the host CPU 41 can obtain the date and time information from the dedicated module or the satellite radio wave reception processing unit 60 at a flexible timing. This can prevent generation of an unwanted waiting time of a user until the second synchronization point and an unwanted increase in the operation time of the satellite radio wave reception processing unit 60.

The method of outputting the date and time information by the satellite radio wave reception processing unit 60 according to the embodiment involves the date and time acquiring step for acquiring the primary date and time information from the reception signals identified from the satellite radio waves by the RF unit 61 and the capture tracking unit 624, and the outputting step for outputting the date and time notifying signal indicating the date and time based on the primary date and time information to the host CPU 41. The date and time notifying signal includes at least the timing signal indicating a predetermined timing. The outputting step includes determining the outputting timing of the timing signal without consideration of the timing of the second synchronization point, which is the leading edge of every second in the date and time based on the primary date and time information, and outputting the timing signal at the output timing.

Such a configuration can flexibly transmit the date and time information from the satellite radio wave reception processing unit 60 to the external host CPU 41, reduce an unwanted waiting time in connection with the uneven transmission, from the satellite radio wave reception processing unit 60, depending on the timing of the identification of the date and time at the satellite radio wave reception processing unit 60, and stably transmit the date and time information from the satellite radio wave reception processing unit 60.

In particular, the satellite radio wave reception processing unit 60 dedicated for the electronic timepiece 1 can output the date and time information in any format other than the typical second-scale format without consideration of the compatibility of the output format of the satellite radio wave reception processing unit 60 with the output formats of the other devices. This configuration facilitates a flexible and proper output of the date and time information.

A program 623A according to the embodiment causes the computer (module CPU 621) of the satellite radio wave reception processing unit 60 provided with the RF unit 61 and the capture tracking unit 624 which receives satellite radio waves to identify the reception signal to function as: a date and time acquisition member for acquiring the primary date and time information from the identified reception signal; and an output member for outputting the date and time notifying signal indicating the date and time based on the primary date and time information to an external device. The date and time notifying signal includes at least a timing signal indicating a predetermined timing. The output member determines the predetermined timing without consideration of the timing of the second synchronization point, which is the leading edge of every second in the date and time based on the primary date and time information, and outputs the timing signal at the predetermined timing.

The program 623A preliminarily stored in the storage unit 623 functions as software that can readily and flexibly control the output timing of the acquired date and time information from the satellite radio wave reception processing unit 60 to an external device (the host CPU 41) without the need for additional functional configurations in the form of software. In particular, the date and time information can be immediately output, which can reduce an unwanted waiting time until the output, improve the convenience of users, and reduce operation power consumption.

Second Embodiment

An electronic timepiece 1A according to a second embodiment will now be described.

Figure 6:
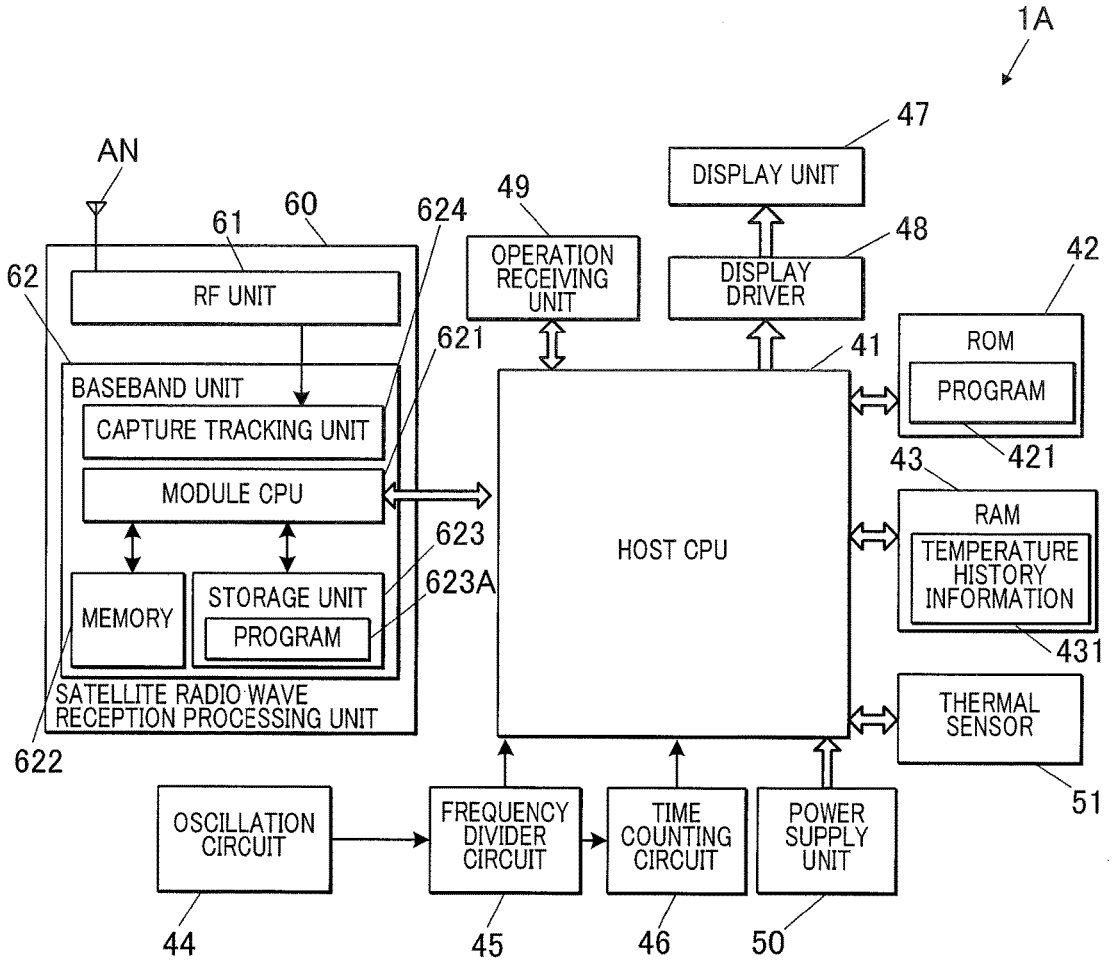
FIG. 6 is a block diagram illustrating a functional configuration of an electronic timepiece according to a second embodiment.

FIG. 6 is a block diagram illustrating the functional configuration of the electronic timepiece 1A according to the second embodiment.

The electronic timepiece 1A includes a thermal sensor 51 as a temperature measuring unit and the RAM 43 stores temperature historical information 431 (historical information of operating temperatures). The other configuration is identical to the electronic timepiece 1 according to the first embodiment. The same components are designated with the same reference numerals without redundant description.

In this embodiment, the thermal sensor 51 measures the temperature around the quartz oscillator of the oscillation circuit 44, namely, the operating temperature related to the counting operation by the oscillation circuit 44, the frequency divider circuit 45, and the time counting circuit 46 (time counting unit). The thermal sensor 51 is, preferably but not limited to, an IC chip including a compact analog sensor that is disposed together with the host CPU 41 on a common substrate.

The measured values of the temperatures measured by the thermal sensor 51 are received by the host CPU 41 at a predetermined interval and stored as the temperature historical information 431 in the RAM 43 within an available region. Alternatively, the average value and the elapsed time for the average value or the number of pieces of measured data from which the average value is calculated may be stored and the average value may be updated after every measurement of the temperature. Alternatively, the temperatures may be continuously measured and the temperature after a large temperature variation and the timing of the large temperature variation may be stored. Instead of directly storing the measured values of the temperatures as the temperature historical information 431, differences from the reference temperature or index values corresponding to the differences may be stored.

The operation for correcting the date and time of the electronic timepiece 1A according to the embodiment will now be described.

The date and time correcting operation does not expressly output the current date and time from the satellite radio wave reception processing unit 60 if the assumed maximum deviation amount of the date and time counted by the time counting circuit 46 is within a predetermined range.

As described above, the time counting circuit 46 counts date and time based on the clock signal generated by the oscillation circuit 44 including the quartz oscillator within an error of less than 0.6 seconds (for example, 0.50 seconds or 0.58 seconds) per day under conditions of general use of the electronic timepiece 1A according to the embodiment. The assumed maximum deviation amount (maximum assumed error) thus can be determined from the elapsed time T from the previous date and time correction; for example, $0.50 \times T/24$ (second). If the date and time information is acquired once a day, the maximum deviation width is within ±0.6 seconds (not inclusive of the upper and lower limits). Since the oscillating frequency of the quartz oscillator varies with the temperature, the direction (positive or negative) of the deviation can be determined based on the history of the temperature since the latest date and time correction or the current temperature in reference to the reference temperature. In this embodiment, the satellite radio wave reception processing unit 60 can output the timing signal every 0.6 seconds in synchronization with the timing of the leading edge of each word. The host CPU 41 can detect the timing signal to identify the time difference from the timing of the leading edge of the word corresponding to the date and time counted by the time counting circuit 46.

Figure 7A:
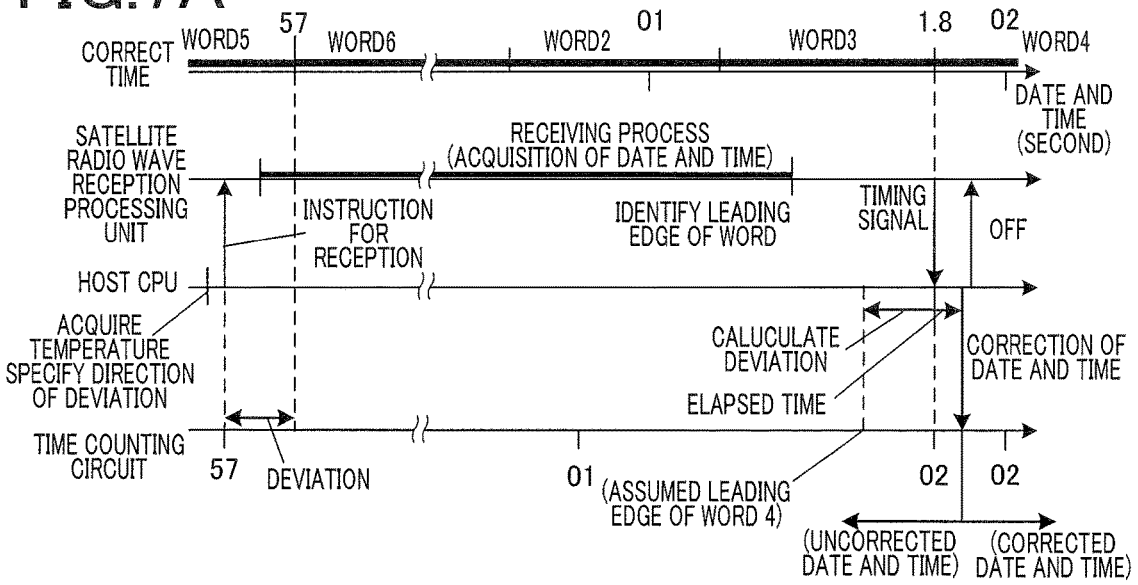
FIG. 7A is a chart of an acquiring operation of the date and time information by the electronic timepiece according to the second embodiment.
Figure 7B:
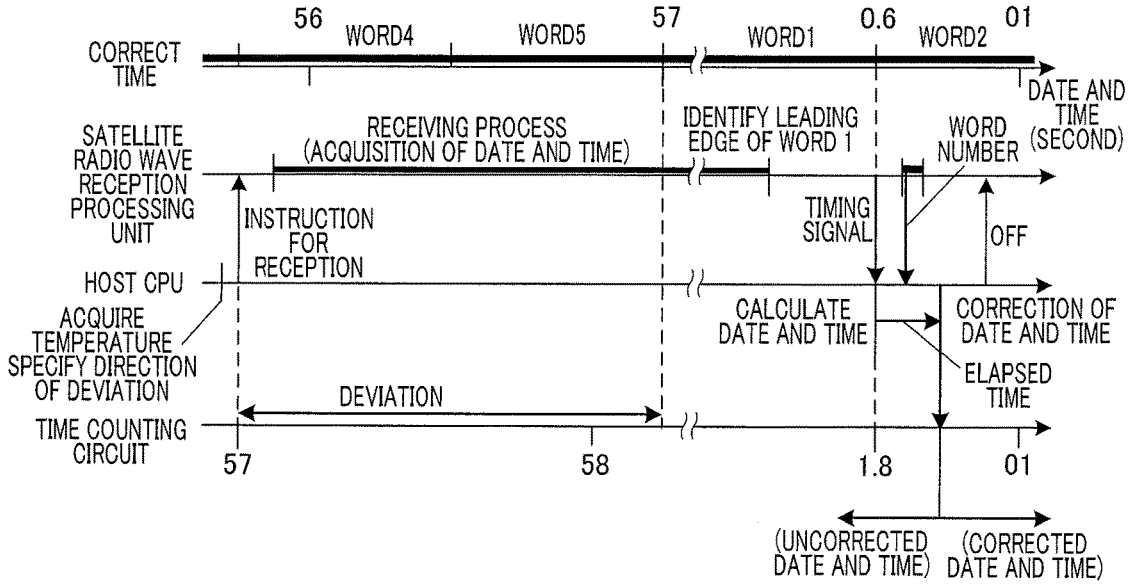
FIG. 7B is a chart of an acquiring operation of the date and time information by the electronic timepiece according to the second embodiment.

FIGS. 7A and 7B are timing charts of the operation for acquiring the date and time information according to the embodiment.

With reference to FIG. 7A, the current temperature measured by the thermal sensor 51 and the temperature historical information 431 since the previous correction of the date and time is preliminarily acquired to specify the direction of the deviation of the date and time after the previous date and time correction. This embodiment simulates the condition where the date and time counted by the time counting circuit 46 includes an advance from the correct date and time.

The host CPU 41 then outputs, to the satellite radio wave reception processing unit 60, the instruction to start reception of radio waves from the GPS satellite at the timing of 57 seconds counted by the time counting circuit 46. If the timing of the leading edge of the word is determined by the satellite radio wave reception processing unit 60 (in FIG. 7A, the determination of the leading edge is moved forward in consideration of a delay due to the propagation of the radio wave from the GPS satellite to the current position, and is determined in the middle of WORD 3), the satellite radio wave reception processing unit 60 outputs the timing signal at the leading edge of WORD 4 (the first word after the acquisition of the date and time information). The leading edge of WORD 4 in Sub-frame 1 is at a timing of 1.8 seconds which corresponds to 2.0 seconds counted by the time counting circuit 46. Since the date and time counted by the time counting circuit 46 is already determined to include an advance of less than 0.6 seconds, the first leading edge after 1.8 seconds counted by the time counting circuit 46 is identified to be the leading edge of WORD 4. Namely, the advance time is determined to be 0.2 seconds. The correct date and time can be calculated by addition of the elapsed time from the input of the timing signal to the 1.8 seconds. The date and time determined by the time counting circuit 46 is corrected with the correct date and time.

As described above, the date and time can be determined without expressly acquiring the date and time information, and the date and time counted by the time counting circuit 46 can be immediately corrected with the determined advancing time.

Alternatively, the timing signal may be output without being aligned along the timing of the leading edge of every word, and the millisecond-order time difference between the timing signal and the actual leading edge of the word may be continuously output.

If more than a day has passed from the previous date and time correction, the date and time counted by the time counting circuit 46 may have a deviation of 0.6 seconds or greater from the correct date and time. In this case, the deviation in 12 days after the previous date and time correction is less than 6 seconds, i.e., a deviation within a single sub-frame. In such a case, the direction of the deviation is determined, and the number of the identified word is output to the host CPU 41 after the transmission of the timing signal. This configuration can readily transmit the correct time and date to the host CPU 41, with less amount of data, without outputting the entire date and time information or expressly outputting a millisecond-order time difference.

If the deviation amount (assumed maximum deviation amount) is 0.6 seconds or greater that corresponds to the length of a single word (1.2 second advance, for example) as shown in FIG. 7B, the time counting circuit 46 already counts 1.8 seconds at the input timing (0.6 seconds) of the leading edge of WORD 2 in the host CPU 41. What word before WORD 4 has the leading edge at the timing of 1.8 seconds thus cannot be determined only with the timing signal. To determine the corresponding word, information on the number of the corresponding word is output from the satellite radio wave reception processing unit 60 after the output of the timing signal. This output of only the number of the corresponding word after the output of the timing signal from the satellite radio wave reception processing unit 60 can determine that the timing signal is output at the timing of 0.6 seconds which corresponds to the leading edge of the WORD 2. The date and time determined by the time counting circuit 46 is thus corrected with the correct date and time calculated based on the timing of 0.6 seconds and the elapsed time from the input of the timing signal.

For determination of only the leading edge or the number of the word from the received code strings, all of the code strings are not necessarily identified. Now described is the case where identification of the leading edge of the word is determined when each of the parity values obtained from the code strings identified from two consecutive words coincides with each of the parity code strings contained in the words, for example. After detection of an 8-bit code string which corresponds to a preamble, if the parity value obtained from the code string containing the preamble identified through demodulation/decoding of WORD 1 does not coincide with the identified parity code string, the identification of the preamble may include any error. In addition, if the parity value obtained from the code string containing a TOW-count identified through demodulation/decoding of WORD 2 does not coincide with the identified parity code string, the decoded value of the TOW-count may include any error. However, if each of the parity values obtained from the code strings identified in subsequent WORDs 3 and 4 coincides with each of the identified parity code strings, it may be determined that the leading edge position and the number of each word corresponding to the previously-identified preamble code string is identified. If the identification of the preamble includes an error, the same process can be conducted based on the correct preamble detected through any subsequent identification. Such processes do not necessarily require the accurate identification of all of the codes in WORDs 1 and 2, resulting in a decrease in the reception time. In this case, the time difference between the timing of the leading edge of the identified word and the subsequent timing exactly on the second varies depending on the identified word.

Figure 8:
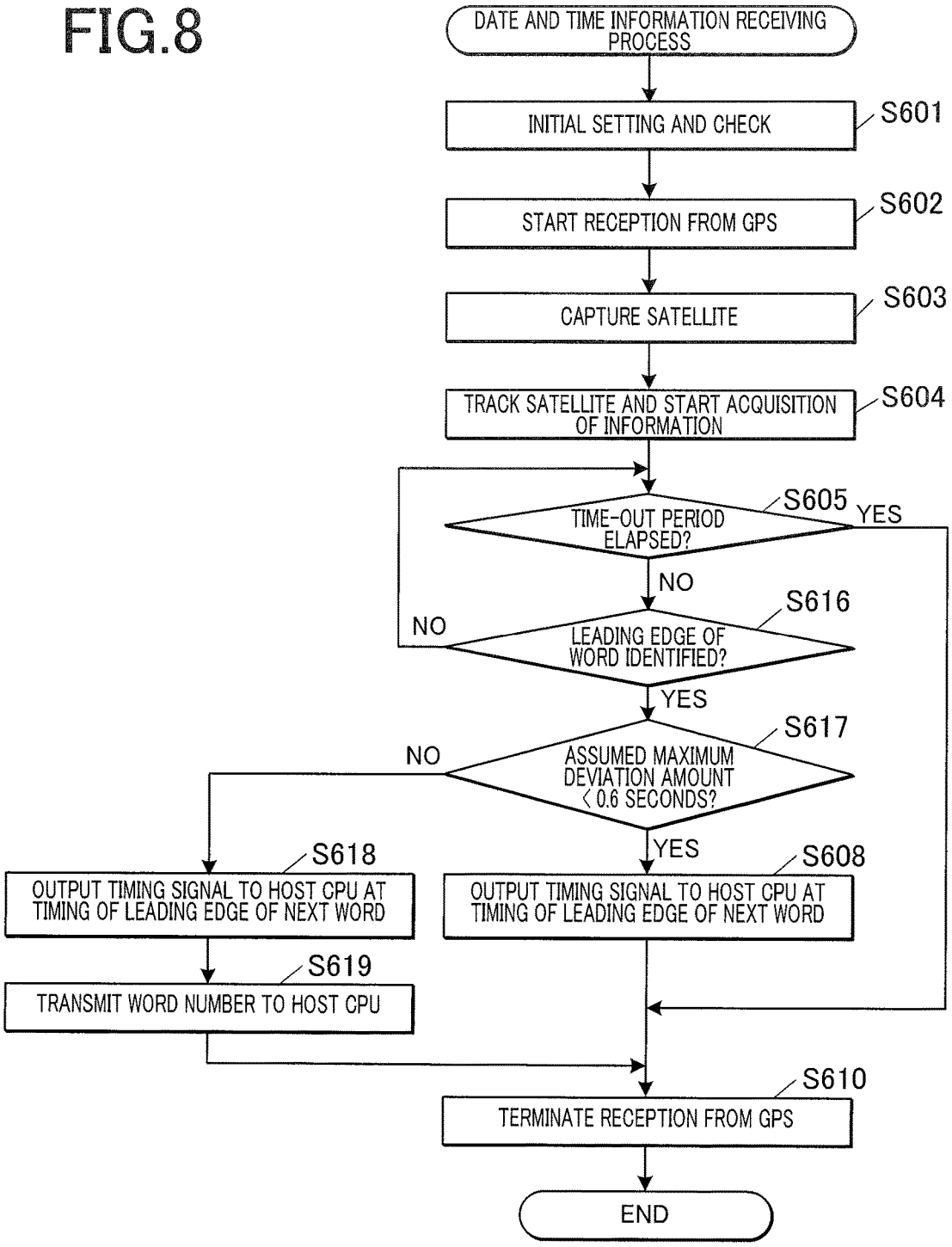
FIG. 8 is a flow chart illustrating a control procedure for date and time information receiving process executed in the electronic timepiece according to the second embodiment.

FIG. 8 is a flow chart illustrating a control procedure of the module CPU 621 for date and time information receiving process executed in the electronic timepiece 1A according to the embodiment.

The procedure for the date and time information receiving process according to the second embodiment involves Steps S616 to S619 in place of Steps S606, S607 and S609 in the procedure for the date and time information receiving process by the electronic timepiece 1 according to the first embodiment. The other steps in the procedure according to the second embodiment are the same as those according to the first embodiment, and the same steps are designated with the same reference numerals without redundant description.

In the initial setting in Step S601, the module CPU 621 preliminarily receives, from the host CPU 41, the maximum error information containing the assumed maximum deviation amount of the date and time counted by the time counting circuit 46 from the correct date and time.

If the lapse of the time-out period is not determined in Step S605 ("NO" in Step S605), the module CPU 621 determines whether the leading edge of any word is identified or not (Step S616). If identification of the leading edge of any word is not determined ("NO" in Step S616), the procedure of the module CPU 621 returns to Step S605.

If identification of the leading edge of any word is determined ("YES" in Step S616), the module CPU 621 determines whether the assumed maximum deviation amount is less than 0.6 seconds or not (Step S617). If the assumed maximum deviation amount is less than 0.6 seconds ("YES" in Step S617), the module CPU 621 outputs a timing signal to the host CPU 41 at the timing of the leading edge of the next word (Step S608). The procedure of the module CPU 621 then goes to Step S610.

If the assumed maximum deviation amount is not less than 0.6 seconds (i.e., if the assumed maximum deviation amount is 0.6 seconds or greater) ("NO" in Step S617), the module CPU 621 outputs a timing signal to the host CPU 41 at the timing of the leading edge of the next word (Step S618), and then outputs the number of the word to the host CPU 41 (Step S619). The procedure of the module CPU 621 goes to Step S610.

The assumed maximum deviation amount as the reference time in Step S617 may be changed from 0.6 seconds to 0.3 seconds if the direction of the deviation of the time and date counted by the time counting circuit 46 cannot be specified by the host CPU 41, as described below.

Figure 9:
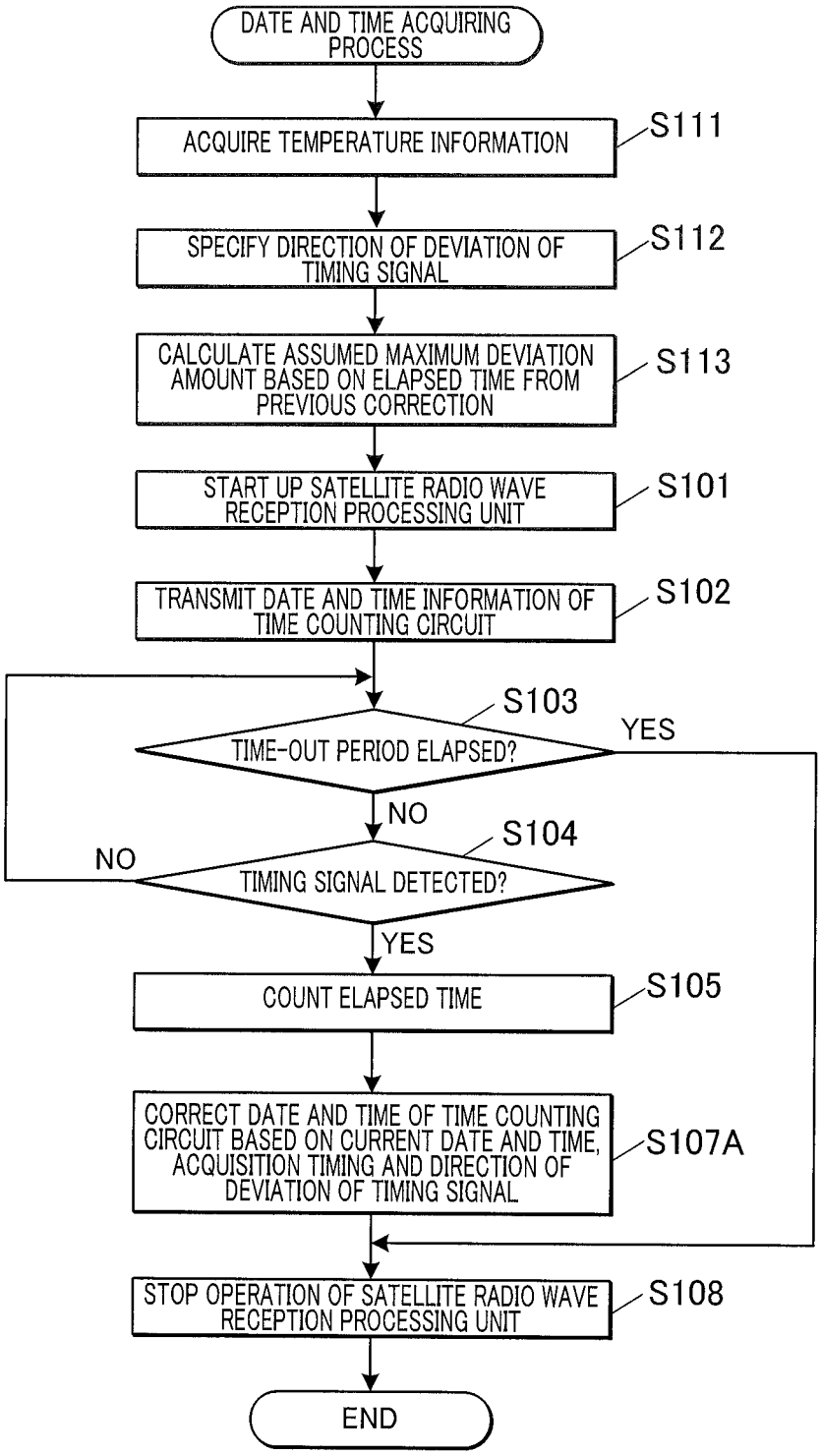
FIG. 9 is a flow chart of a control procedure for date and time acquiring process executed in the electronic timepiece according to the second embodiment.

FIG. 9 is a flow chart of a control procedure by the host CPU 41 for date and time acquiring process executed in the electronic timepiece 1A according to the second embodiment.

The date and time acquiring process according to the second embodiment involves additional Steps S111 to S113, does not involve Step S106, and involves Step S107A in place of Step S107 in the date and time acquiring process by the electronic timepiece 1 according to the first embodiment. The other steps in the procedure according to the second embodiment are the same as those according to the first embodiment, and the same steps are designated with the same reference numerals without detailed description.

At the start of the date and time acquiring process, the host CPU 41 acquires the temperature data measured by the thermal sensor 51 and the temperature historical information 431 from the RAM 43 (Step S111). The host CPU 41 specifies the direction of the deviation of the date and time after the previous date and time correction based on the acquired temperature data (Step S112). If the direction of the deviation cannot be specified due to an increase and a decrease in temperature from the reference temperature, the direction of the deviation may be determined as "unspecified".

The host CPU 41 acquires the elapsed time from the previous date and time correction to determine an assumed maximum deviation amount based on the elapsed time (Step S113). The procedure of the host CPU 41 then goes to Step S101.

After starting the count of the elapsed time after the detection of the timing signal (Step S105), the host CPU 41 identifies the transmission date and time of the word corresponding to the reception timing of the timing signal based on the current date and time counted by the time counting circuit 46, the reception timing of the timing signal, and the direction of the deviation of the timing signal identified in Step S112. The host CPU 41 then corrects the date and time counted by the time counting circuit 46 based on the transmission date and time and the elapsed time for which counting is started in the Step S105 (Step S107A). As described above, the timing of the reception of a signal at the satellite radio wave reception processing unit 60 has a deviation corresponding to the propagation time from the timing of the transmission of the signal from the GPS satellite. In this embodiment, the actual reception timing is thus moved forward by the deviation (80 msec, for example) to determine the transmission timing of the GPS satellite. If the assumed maximum deviation amount is 0.6 seconds or greater (0.3 seconds or greater when the direction is unspecified), the host CPU 41 refers to the word number input subsequently to the timing signal and identifies the transmission date and time at the leading edge of the word.

The procedure of the host CPU 41 then goes to Step S108.

As described above, in the electronic timepiece 1A according to the second embodiment, the module CPU 621 obtains from the host CPU 41 the secondary date and time information counted by the time counting circuit 46 and the maximum error information on the maximum error (assumed maximum deviation amount) assumed to be contained in the date and time indicated by the secondary date and time information, and outputs to the host CPU 41 the information indicating a part of date and time, by which information the date and time can be specified, e.g. the date and time notifying signal including the timing information of the leading edge of the word, within the range of the assumed maximum deviation amount, e.g. within less than 0.6 seconds, based on the secondary date and time information, from among the date and time corresponding to the primary date and time information acquired from the radio waves from the positioning satellite.

The time required for the transmission of each word is less than 1 second (0.6 seconds). The module CPU 621 outputs the timing signal at the transmission timing of the leading edge of the first word after the acquisition of the primary date and time information. This operation can readily determine the corresponding date and time, facilitating the output of the date and time information. When only the word number is transmitted to the host CPU 41 or when the error is within an acceptably small range, the output of the date and time information on the output timing of the timing signal may be omitted and the date and time within the assumed maximum deviation amount can be determined at the host CPU 41.

The electronic timepiece 1A includes the thermal sensor 51 that measures the operating temperatures of the time counting circuit 46. The host CPU 41 calculates the assumed maximum deviation amount of the date and time counted by the time counting circuit 46 based on the elapsed time from the latest correction of the date and time counted by the time counting circuit 46 and the measured value of the operating temperatures obtained by the thermal sensor 51, outputs the information on the date and time counted by the time counting circuit 46 as the secondary date and time information to the satellite radio wave reception processing unit 60 to request the acquisition of the primary date and time information, and outputs the maximum error information on the assumed maximum deviation amount to the satellite radio wave reception processing unit 60. This operation facilitates appropriate estimation of the assumed error in the date and time counted by the time counting circuit 46, appropriate reception of the date and time information within the range of the error by the satellite radio wave reception processing unit 60, and appropriate reception of the date and time information by the host CPU 41 from the satellite radio wave reception processing unit 60. In particular, since the direction of the deviation of the time and date counted by the time counting circuit 46 can be determined based on the magnitude relation between the reference temperature and the measured temperature, the date and time information can be readily and appropriately obtained from the received radio waves, and the host CPU 41 can receive the date and time information from the satellite radio wave reception processing unit 60 in a short time. Accordingly, effects of a relatively long waiting time until the second synchronization point can be reduced and the date and time information can be stably acquired.

In addition, the electronic timepiece 1A includes the RAM 43 that stores the temperature historical information 431 of the operating temperature measured by the thermal sensor 51. The host CPU 41 calculates the assumed maximum deviation amount of the date and time counted by the time counting circuit 46 based on the temperature historical information 431 from the previous correction of the date and time counted by the time counting circuit 46 to the request for the acquisition of the primary date and time information to the satellite radio wave reception processing unit 60.

In other words, the error can be cumulatively estimated based on the variation in temperature during the period when the date and time counted by the time counting circuit 46 is not corrected. This configuration can perform an accurate and appropriate acquisition of the date and time information.

The embodiments described above should not be construed to limit the present invention, and various modifications can be made.

For example, the embodiments describe above are based on the acquisition of the date and time based on the reception of the radio waves from a single positioning satellite. Alternatively, navigation messages may be received from several positioning satellites to perform positioning and to acquire the date and time information. If navigation messages are received from plural (i.e. two or three) positioning satellites that are difficult to perform positioning or requires predetermined conditions to perform positioning, the relative deviations of the dates and times obtained from the navigation messages may be appropriately adjusted to acquire the correct date and time.

The timing signal is not necessarily output after the reception of the date and time at the satellite radio wave reception processing unit 60, and may be output in response to the reception of the necessary information (code string) to acquire the date and time, in parallel with the actual calculation of the date and time, for example. In this case, the calculated date and time dates back to the output timing of the timing signal, and the information on the date and time of the output of the timing signal is output to the host CPU 41.

In the above embodiments, the radio controlled timepieces 1, 1A can correct the date and time through the reception of the radio waves from the positioning satellites; alternatively, the radio controlled timepieces 1, 1A may correct the date and time through the other scheme, for example, the reception of long-wavelength (standard) radio waves. In this case, the previous date and time correction, which is used as the reference value for the calculation of the elapsed time from the previous date and time correction, can use any correction methods.

The maximum error information transmitted from the host CPU 41 to the module CPU 621 may include, for example, the date and time of the previous date and time correction for calculating the assumed maximum deviation amount or the elapsed time from that date and time, and the information on the rate, in addition to the calculated assumed maximum deviation amount. In this case, the module CPU 621 in the satellite radio wave reception processing unit 60 calculates the assumed maximum deviation amount. In addition to or in place of the preservation of the corrected historical information in the RAM 43, the transmission history of the date and time information to the host CPU 41 may be stored in the storage unit 623 of the satellite radio wave reception processing unit 60, and the transmission history may be used as the correction history.

The assumed maximum deviation amount may be calculated based on parameters other than the elapsed time from the previous date and time correction and the information on the operating temperatures.

Although the timing signal is output in the form of the pulse signal in the above embodiments, the timing signal may have any waveform from which a single timing can be identified, other than a pulse signal, which is a rectangular signal having a short rising time.

In the above embodiments, the satellite radio waves are transmitted from the positioning satellites of the GPS; however, the radio waves may be transmitted from any other positioning system. For example, the radio waves may be received from the GLONASS, the Galileo, or the Michibiki (positioning satellite in the Quasi-Zenith satellite system) to acquire the date and time information. In this case, the range of the date and time information to be received and identified with respect to the assumed maximum deviation amount may be determined depending on the format of the navigation message from each positioning satellite.

In the above embodiments, the date and time information is output from the satellite radio wave reception processing unit 60 to the radio controlled timepieces 1, 1A; however, the date and time information may be output to any external electronic device that can process the acquired date and time information in any scheme.

In the above embodiments, the processors performing the controlling operations are the module CPU 621 and the host CPU 41; however, the controlling operation may be performed by any other configuration other than the software control by the CPU. Part or the overall controlling operation may be conducted by a hardware configuration, such as dedicated logic circuitry.

In the above description, the storage unit 623, which is composed of a non-volatile memory such as a flash memory, is described as an example of a computer readable recording media that stores the program 623A for the management of the remaining capacity of the battery according to the present invention; however, the storage unit 623 is a mere non-limiting example. Other example of the computer readable recording medium may include a portable recording medium, such as a Hard Disk Drive (HDD), a CD-ROM, and a DVD. The data in the program according to the present invention may be transmitted on carrier waves via a communication line.

The specific details on the configurations, control procedures, and displaying in the embodiment described above may be appropriately modified without departing from the scope of the present invention.

The embodiments of the present invention described above should not be construed to limit the scope of the present invention, and the invention disclosed in the claims and the equivalent thereof are included in the scope of the present invention.

What is claimed is:

1. A radio controlled timepiece comprising:

a time counting circuit configured to count date and time;

a satellite radio wave receiving device comprising:

a receiver configured to receive satellite radio waves; and a first processor configured to:

acquire primary date and time information, for correcting the date and time counted by the time counting circuit, from the satellite radio waves received;

in response to completion of acquisition of the primary date and time information from the satellite radio waves received:

set an output timing for outputting a timing notifying signal, the output timing being set to be a predetermined delay from a time of the completion of acquisition of the primary date and time information, irrespective of synchronization with seconds indicated by the primary date and time information;

output the timing notifying signal at the output timing;

determine date and time of outputting the timing notifying signal based on the primary date and time information; and output a set date and time signal indicating the date and time of outputting the timing notifying signal; and a second processor configured to:

detect the timing notifying signal output from the first processor;

count elapsed time from detection of the timing notifying signal;

detect the set date and time signal and acquire the date and time of outputting the timing notifying signal indicated by the set date and time signal detected; and correct the date and time counted by the time counting circuit based on the elapsed time counted and the date and time of outputting the timing notifying signal.

2. The radio controlled timepiece according to claim 1, comprising:

a thermal sensor configured to measure an operating temperature related to a counting operation of the time counting circuit, wherein the second processor is configured to:

calculate a maximum error assumed to be contained in the date and time counted by the time counting circuit based on elapsed time from a latest correction of the date and time counted by the time counting circuit and a measured value of the operating temperature measured by the thermal sensor; and output an instruction signal to the first processor of the satellite radio wave receiving device to acquire the primary date and time information, wherein the instruction signal indicates the maximum error, and wherein first processor of the satellite radio wave receiving device is configured to acquire, as the primary date and time information, date and time information capable of correcting the date and time within the maximum error.

3. The radio controlled timepiece according to claim 2, comprising:

wherein the second processor is configured to:

retrieve, from a storage, historical information of the operating temperature measured by the thermal sensor from a time when the date and time counted by the time counting circuit is lastly corrected to a time when the satellite radio wave receiving device is instructed by the instruction signal to acquire the primary date and time information; and calculate the maximum error based on the historical information.

4. The radio controlled timepiece according to claim 1, wherein the first processor of the satellite radio wave receiving device is configured to:

identify a reception signal from the satellite radio waves received, wherein the reception signal includes an arrangement of plural codes, the arrangement containing a parity-check code for each code block composed of a predetermined number of the codes; and perform a comparison of parity data obtained from the codes of the code block with the parity-check code contained in the code block; and acquire the primary date and time information based on a result of the comparison.

5. The radio controlled timepiece according to claim 4, wherein a time required for transmitting the code block is less than 1 second, and wherein the first processor of the satellite radio wave receiving device is configured to set the output timing for outputting the timing notifying signal at a transmission timing of a leading edge of a first code block after the completion of acquisition of the primary date and time information.

6. The radio controlled timepiece according to claim 5, further comprising:

a thermal sensor configured to measure an operating temperature related to a counting operation of the time counting circuit, wherein the second processor is configured to:

calculate a maximum error assumed to be contained in the date and time counted by the time counting circuit based on elapsed time from a latest correction of the date and time counted by the time counting circuit and a measured value of the operating temperature measured by the thermal sensor; and output an instruction signal to the first processor of the satellite radio wave receiving device to acquire the primary date and time information, wherein the instruction signal indicates the maximum error, and wherein first processor of the satellite radio wave receiving device is configured to acquire, as the primary date and time information, date and time information capable of correcting the date and time within the maximum error.

7. The radio controlled timepiece according to claim 6, wherein the second processor is configured to:

retrieve, from a storage, historical information of the operating temperature measured by the thermal sensor from a time when the date and time counted by the time counting circuit is lastly corrected to a time when the satellite radio wave receiving device is instructed by the instruction signal to acquire the primary date and time information; and calculate the maximum error based on the historical information.

8. The radio controlled timepiece according to claim 4, comprising:

a thermal sensor configured to measure an operating temperature related to a counting operation of the time counting circuit, wherein the second processor is configured to:

calculate a maximum error assumed to be contained in the date and time counted by the time counting circuit based on elapsed time from a latest correction of the date and time counted by the time counting circuit and a measured value of the operating temperature measured by the thermal sensor; and output an instruction signal to the first processor of the satellite radio wave receiving device to acquire the primary date and time information, wherein the instruction signal indicates the maximum error, and wherein first processor of the satellite radio wave receiving device is configured to acquire, as the primary date and time information, date and time information capable of correcting the date and time within the maximum error.

9. The radio controlled timepiece according to claim 8, wherein the second processor is configured to:

retrieve, from a storage, historical information of the operating temperature measured by the thermal sensor from a time when the date and time counted by the time counting circuit is lastly corrected to a time when the satellite radio wave receiving device is instructed by the instruction signal to acquire the primary date and time information; and calculate the maximum error based on the historical information.

10. The radio controlled timepiece according to claim 1, wherein the second processor is configured to control a display to display the date and time counted by the time counting circuit that has been corrected based on the elapsed time counted and the date and time of outputting the timing notifying signal.

11. A method a radio controlled timepiece comprising:

a time counting circuit;

a satellite radio wave receiving device comprising:

a receiver; and a first processor; and a second processor, wherein the method comprises:

controlling the time counting circuit to count date and time;

controlling the receiver of the satellite radio wave receiving device to receive a satellite radio waves;

acquiring, by the first processor, primary date and time information, for correcting the date and time counted by the time counting circuit, from the satellite radio waves received;

in response to completion of acquisition of the primary date and time information from the satellite radio waves received:

setting, by the first processor, an output timing for outputting a timing notifying signal, the output timing being set to be a predetermined delay from a time of the completion of acquisition of the primary date and time information, irrespective of synchronization with seconds indicated by the primary date and time information;

outputting, by the first processor, the timing notifying signal at the output timing;

determining, by the first processor, date and time of outputting the timing notifying signal based on the primary date and time information;

outputting, by the first processor, a set date and time signal indicating the date and time of outputting the timing notifying signal;

detecting, by the second processor, the timing notifying signal output from the first processor;

counting, by the second processor, elapsed time from detection of the timing notifying signal;

detecting, by the second processor, the set date and time signal and acquire, by the second processor, the date and time of outputting the timing notifying signal indicated by the set date and time signal detected; and correcting, by the second processor, the date and time counted by the time counting circuit based on the elapsed time counted and the date and time of outputting the timing notifying signal.

12. The method according to claim 11, comprising:

identifying, by the first processor, a reception signal from the satellite radio waves received, wherein the reception signal includes an arrangement of plural codes, the arrangement containing a parity-check code for each code block composed of a predetermined number of the codes;

performing, by the first processor, a comparison of parity data obtained from the codes of the code block with the parity-check code contained in the code block; and acquiring, by the first processor, the primary date and time information based on a result of the comparison.

13. The method according to claim 12, wherein a time required for transmitting the code block is less than 1 second, and wherein the method comprises setting, by the first processor, the output timing for outputting the timing notifying signal at a transmission timing of a leading edge of a first code block after the completion of acquisition of the primary date and time information.

14. A non-transitory computer-readable recording medium recording instructions for causing a first processor of a satellite radio wave receiving device and a second processor to at least perform:

controlling, by the second processor, a time counting circuit to count date and time;

controlling, by the first processor, a receiver of the satellite radio wave receiving device, to receive satellite radio waves;

acquiring, by the first processor, primary date and time information, for correcting the date and time counted by the time counting circuit, from the satellite radio wave received;

in response to completion of acquisition of the primary date and time information from the satellite radio waves received:

setting, by the first processor, an output timing for outputting a timing notifying signal, the output timing being set to be a predetermined delay from a time of the completion of acquisition of the primary date and time information, irrespective of synchronization with seconds indicated by the primary date and time information;

outputting, by the first processor, the timing notifying signal at the output timing;

determine date and time of outputting the timing notifying signal based on the primary date and time information; and outputting, by the first processor, a set date and time signal indicating the date and time of outputting the timing notifying signal;

detecting, by the second processor, the timing notifying signal output from the first processor;

counting, by the second processor, elapsed time from detection of the timing notifying signal;

detecting, by the second processor, the set date and time signal and acquiring, by the second processor, the date and time of outputting the timing notifying signal indicated by the set date and time signal detected; and correcting, by the second processor, the date and time counted by the time counting circuit based on the elapsed time counted and the date and time of outputting the timing notifying signal.

15. The non-transitory computer-readable recording medium according to claim 14, wherein the instructions cause the first processor and the second processor to at least perform:

identifying, by the first processor, a reception signal from the satellite radio waves received, wherein the reception signal includes an arrangement of plural codes, the arrangement containing a parity-check code for each code block composed of a predetermined number of the codes;

performing, by the first processor, a comparison of parity data obtained from the codes of the code block with the parity-check code contained in the code block; and acquiring, by the first processor, the primary date and time information based on a result of the comparison.

16. The non-transitory computer-readable recording medium according to claim 15, wherein a time required for transmitting the code block is less than 1 second, and wherein the instructions cause the first processor and the second processor to at least perform setting, by the first processor, the output timing for outputting the timing notifying signal at a transmission timing of a leading edge of a first code block after the completion of acquisition of the primary date and time information.

* * * * *